United States Patent [19]

Sawyer et al.

[11] Patent Number: 4,828,675

[45] Date of Patent: May 9, 1989

[54] PROCESS FOR THE PRODUCTION OF ULTRA HIGH OCTANE GASOLINE, AND OTHER FUELS FROM AROMATIC DISTILLATES

[75] Inventors: Willard H. Sawyer; Carl W. Hudson, both of Baton Rouge, La.

[73] Assignee: Exxon Research and Engineering Company, Florham Park, N.J.

[21] Appl. No.: 128,927

[22] Filed: Dec. 4, 1987

[51] Int. Cl.[4] ..... C10G 45/50

[52] U.S. Cl. ..... 208/57; 208/58; 208/59; 208/60; 208/61; 208/78; 208/79; 208/80; 208/89; 208/144; 585/301; 585/260; 585/411

[58] Field of Search ..... 208/59, 57, 58, 61, 208/60, 89, 78, 79, 80, 144; 585/301, 411, 268

[56] References Cited

U.S. PATENT DOCUMENTS

| | | | |
|---|---|---|---|
| 3,071,536 | 1/1963 | Stiles et al. | 208/61 |
| 3,700,586 | 10/1972 | Schulman | 208/89 |
| 3,715,303 | 2/1973 | Wennerberg et al. | 208/61 |
| 3,922,216 | 11/1975 | Wilson et al. | 208/61 |
| 4,022,681 | 5/1977 | Sheng et al. | 208/57 |
| 4,036,735 | 7/1977 | Roselius et al. | 208/89 |
| 4,591,430 | 5/1986 | Hudson | 208/254 H |
| 4,608,153 | 8/1986 | Hudson et al. | 208/112 |
| 4,629,553 | 12/1986 | Hudson et al. | 208/212 |
| 4,664,777 | 5/1987 | Hudson et al. | 208/112 |

*Primary Examiner*—H. M. S. Sneed
*Assistant Examiner*—Helane Myers
*Attorney, Agent, or Firm*—Roy J. Ott

[57] ABSTRACT

A process for the production of high octane gasoline, or high octane gasoline blending components, from a sulfur-containing feed rich in fused two-ring aromatic hydrocarbons, inclusive of naphthalenes. The feed is hydrogenated in a first reaction zone to desulfurize the feed and saturate one ring of the fused two-ring aromatic hydrocarbons, but insufficient to saturate the second ring of said molecular species, to form tetralins. The product, as a feed, is reacted in a second reaction zone over a catalyst comprised of elemental iron and one or more alkali or alkaline-earth metals components to selectively hydrogenate and crack the previously hydrogenated fused two-ring aromatic hydrocarbons to produce lower molecular weight higher octane components suitable per se as gasoline, or gasoline blending components. The feed rich in fused two-ring aromatic hydrocarbons can be split from a wider boiling range hydrocarbon to obtain, additionally, a component rich in fused multi-ring aromatic hydrocarbons having three or more rings to the molecule, which fraction can also be hydrogenated to produce other fuels, or raw materials feed components.

37 Claims, No Drawings

PROCESS FOR THE PRODUCTION OF ULTRA HIGH OCTANE GASOLINE, AND OTHER FUELS FROM AROMATIC DISTILLATES

RELATED APPLICATIONS

This application is related to Application Ser. No. 611,859, filed May 18, 1984, titled "Process for the Denitrogenation of Nitrogen-Containing Hydrocarbon Compounds" by Carl W. Hudson, now abandoned, and Application Ser. No. 635,729, filed July 30, 1984, titled "Process for the Removal of Polynuclear Aromatic Hydrocarbon Compounds From Admixtures of Liquid Hydrocarbon Compounds" by Carl W. Hudson and Glen P. Hamner, now abandoned and replaced by Application Ser. No. 760,894, a continuation-in-part thereof, titled "Process For Improving Octane By The Conversion of Fused Multi-Ring Aromatics and Hydroaromatics to Lower Molecular Weight Compounds." The latter was issued on May 12, 1987 as U.S. Pat. No. 4,664,777.

Other related applications are: Application Ser. No. 760,871 by Carl W. Hudson (now U.S. Pat. No. 4,591,430 issued May 27, 1986; Application Ser. No. 760,961 by Carl W. Hudson and Glen P. Hamner (now U.S. Pat. No. 4,608,153 issued Aug. 26, 1986; Application Ser. No. 760,834 by Carl W. Hudson and Gerald E. Markley (now U.S. Pat. No. 4,629,553 issued Dec. 16, 1986; Application Ser. No. 760,962 by Carl W. Hudson and Glen P. Hamner; and Application Ser. No. 760,835 by Carl W. Hudson and Glen P. Hamner; Filed July 31, 1985 (now U.S. Pat. No. 4,618,472 issued Oct. 21, 1986).

BACKGROUND OF THE INVENTION

I. Field of the Invention

This invention relates to a process for the production of high octane motor gasoline components, and other fuels. In particular, it relates to a process for the production of high octane motor gasoline, or high octane motor gasoline components, from highly aromatic mid distillate product streams, or streams which contain high concentrations of multi-ring aromatic or hydyroaromatic compounds, whether derived from petroleum or synthetic sources, or both.

II. Background and Prior Art

Usually more than one-half of every barrel of petroleum crude that is processed in a modern refinery is converted into motor gasolines. Motor gasolines are produced from a blending pool of streams obtained from many different refinery processes, primarily from catalytic reforming and alkylation processes. Motor gasolines are constituted principally of complex mixtures of paraffins, naphthenes, olefins and aromatic hydrocarbons, which generally boil within a range of from about $C_5+-430°$ F. (20°-225° C.). Improved engine performance demands significantly improved motor gasoline octane requirements. Due to restrictions on the use of alkyl lead compounds, with the ultimate projection which will require prohibition of the use of such compounds in gasolines altogether, refiners are taxed in their ability to produce high octane blending components. Consequently there is a demand upon refiners to find ways and means of increasing the octane number levels of their motor gasoline pools.

Catalytic cracking, or "cat cracking," is another refinery process for producing major quantities of motor gasoline. It also suffers a major deficiency however in that it produces large quantities of highly aromatic light cat cycle oil (LCCO) due to the high temperature of the operation. The LCCO, having an API gravity of 10-15, is difficult to market for which reason it is often hydrogenated and then blended with kerosenes (a jet fuel stock) to increase its API gravity (to 30 API) so that the product can be sold as heating oil. A relatively high value product is thus used up, and depreciated in value, to make the LCCO a marketable product. LCCO, after hydrogenation, is also added to automotive diesel fuel and the product sold as automotive diesel fuel, but such manner of disposing of the LCCO is necessarily limited. Whereas conventional hydrogenation processes might be used to upgrade the LCCO this is not practical because excessive hydrogen consumption is required to increase the cetane and gravity to meet diesel specifications. On the other hand, catalytic hydrocracking processes are not efficient in producing motor gasoline blending components because these processes produce a hydrogen-rich motor gasoline component which first must be reformed before it can meet octane specifications. This, of course, adds to the cost of octane values obtained from catalytic hydrocracking processes. Additionally, conventional hydrocracking catalysts crack paraffin molecules into lower boiling paraffins which effectively reduces the octane value of the product.

Highly aromatic mid distillate streams are also available from synthetic fuel processes, e.g., coal liquification processes, and steam cracking operations for the production of olefins, e.g., steam cracker light gas oil. The product streams derived from these processes, and the problems associated with the disposition of these products is closely akin to those described above for the disposition of petroleum stocks.

In U.S. Application Ser. No. 760,894, supra, there is described a process for the production of gasoline from feeds characterized as mixtures of fused two-ring aromatic and hydroaromatic hydrocarbons which are reacted with hydrogen, over a catalyst characterized as elemental iron and one or more alkali or alkaline-earth metal components at temperatures ranging about 225° C. to 430° C. The feed is selectively hydrogenated and hydrocracked over the iron catalyst to produce a lower molecular weight high octane product. Whereas this process represents a meritorious advance in the state of the art much of the gasoline product resultant from this process is of lesser octane than desirable due to contamination of the product with low octane refractory components included in the feed. In addition, it is now recognized that in this process the levels of conversion of the mixed fused two-ring aromatic and hydroaromatic hydrocarbons to molecular species useful as gasoline blending components is relatively low. Many of the molecular species found in available feed streams whether from petroleum or synthetic sources, notably paraffins and naphthenes, simply do not react over the iron catalyst. Moreover, other molecular species of these mixtures, notably aromatic hydrocarbons having three rings and greater in the molecule, react in a manner detrimental to the life of the catalyst. Other species consume too much hydrogen and produce end products of no greater value, or of lesser value, than the molecular species originally present in the feed.

There presently exists a pressing need for a further improved process useful for the conversion to lower boiling hydrocarbons of higher octane levels suitable for direct use in gasoline, or as motor gasoline blending components, or diesel fuel, or both, of highly aromatic mid distillates derived from cat cracking petroleum stocks (such as light cat cycle oil; or the heavy hydrocrackate thereof), liquification of coal or the hydroconversion of heavy feeds (such as bitumen, tar sands, etc.) which contain high concentrations of multiring aromatic or hydroaromatic compounds.

III. Objects

It is, accordingly, the primary object of this invention to fill this and other needs.

In particular, it is an object of this invention to provide a process for the conversion of highly aromatic mid distillates, e.g., LCCO, or LCCO and related fuel fractions such as those obtained from synthetic and chemicals operations, or admixtures of such fuel factions, into lower boiling, high octane gasolines or motor gasoline blending components.

A specific object is to provide a process for the conversion of highly aromatic mid distillates, e.g. LCCO, or LCCO and said related fuel fractions, or admixtures of such fuel fractions, to motor gasoline of higher octane, or to high octane motor gasoline blending components.

A further, and yet more specific object, is to provide a process for the treatment of feed fractions from conventional or synthetic sources, or both, containing fused two-ring aromatic and hydroaromatic hydrocarbons of selected boiling range to coproduce, on reaction of the feed, with hydrogen, over an iron catalyst as described in U.S. Ser. No. 760,894, now U.S. Pat. No. 4,664,777 supra, a higher octane gasoline, and mid distillate useful as a diesel fuel, or diesel and/or jet fuel blending stock.

IV. The Invention

These objects and others are achieved in accordance with the process of this invention the steps of which include, (A) in processing a sulfur-containing feed comprised of a blend rich in molecular species characterized as fused two-ring aromatic hydrocarbons, inclusive of naphthalenes, and sulfur-containing hydrocarbon compounds, boiling within a range of from about 400° F. to about 600° F., preferably from about 400° F. to about 575° F., as obtained by distillation from a wider boiling range composition, e.g., a LCCO, (1A) hydrogenating said feed over a hydrogenation catalyst at hydrogenation conditions sufficient to remove sulfur, preferably to 10 parts, per million parts (ppm), by weight of feed, or less and saturate one ring of said molecular species, inclusive of naphthalenes, but insufficient to saturate the second ring of said molecular species, (1AA) contacting and reacting in an optional, but preferred step, the hydrogenated product from (1A), supra, as a feed with a hydroisomerization catalyst at conditions sufficient for rearrangement of the molecular species of said hydrogenated product to form indanes and other molecular species, and increase the concentration of indanes and other molecular species in said product, and then (2A) contacting the hydrogenated product from (1A) or 1AA), supra, as a feed in the presence of hydrogen, over a catalyst comprised of elemental iron and one or more alkali or alkaline-earth metals components at a temperature ranging from about 225° C. (437° F.) to about 430° C. (806° F.), preferably from about 250° C. (482° F.) to about 400° C. (752° F.), and hydrogen partial pressure ranging generally from about 0 pounds per square inch gauge (psig) to about 1000 psig, preferably from about 100 psig to about 600 psig to selectively further hydrogenate and crack said previously hydrogenated fused two-ring aromatic hydrocarbon (or molecular species one ring of which was previously hydrogenated with minimal hydrogenation of the second ring of said species) to produce lower molecular weight, high octane components suitable per se as gasoline or suitable for use as a motor gasoline blending component; or, (B) in processing a wider boiling range sulfur-containing feed, or sulfur and nitrogen-containing feed composition constituted of fused multi-ring aromatic hydrocarbons containing two, and three or more rings in the molecule, and sulfur-containing hydrocarbon compounds.

(1B) splitting the feed into two liquid feed fractions, (a) a first feed fraction constituting a blend rich in fused two-ring aromatic hydrocarbons, inclusive of naphthalenes, boiling within a range of from about 400° F. to about 600° F., preferably from about 400° F. to about 575° F., and (b) a second feed fraction constituting a blend rich in fused multi-ring aromatic hydrocarbons having three or more rings in the molecule and boiling within a range of from about 600° F. to about 750° F., preferably from about 575° F. to about 650° F., (2B) hydrogenating over a hydrogenation catalyst at hydrogenation conditions said first feed fraction at the conditions defined in (1A), supra, sufficient to remove sulfur, preferably to 10 ppm by weight, or less, and saturate one ring of the fused two-ring aromatic hydrocarbon species, inclusive of naphthalenes, but insufficient to saturate the second ring of said molecular species, (2BB) contacting and reacting in an optional, but preferred step, the hydrogenated product from (2B), supra, as a feed with a hydroisomerization catalyst at conditions sufficient for rearrangement of the molecular species of said hydrogenated product to form indanes and other molecular species, and increase the concentration of indanes and other molecular species in said product, and then (3B) contacting said hydrogenated first feed fraction obtained form step (2B) or (2BB) in the presence of hydrogen, over an iron catalyst as defined in A (2A) at the conditions defined in A (2A) to selectively hydrogenate and crack said previously hydrogenated fused two-ring aromatic hydrocarbon to produce lower molecular weight, higher octane components suitable per se as gasoline or a motor gasoline blending component, and (4B) contacting said second feed fraction rich in fused multi-ring aromatic hydrocarbons containing three or more rings to the molecule as defined in 1B (b) over a hydrogenation catalyst, in the presence of hydrogen, at temperature and pressures sufficient to hydrogenate the fused multi-ring aromatic hydrocarbon components and produce molecular components directly useful as blending components for diesel or heating oil; or suitable as feedstock for recycle to a "cat cracker" for conversion to lower molecular weight lighter boiling components to produce motor gasoline or motor gasoline blending components; or suitable as a feedstock for conversion over a hydrocracking catalyst, in the presence of hydrogen at temperature and pressure sufficient to hydrocrack the fused multi-ring aromatic hydrocarbon components and product lower molecular weight lighter boiling components useful as motor gasoline or motor gasoline blending components; or (C) in processing said wider boiling range sulfur-and nitrogen-containing feed constituted of fused multi-ring aromatic hydrocarbons containing two, and three or more rings in the molecule as defined in (B), supra, and sulfur-containing hydrocarbon compounds, (1C) hydrogenating over a hydrogenating catalyst at hydrogenation conditions, the whole feed at conditions sufficient to remove sulfur and nitrogen, particularly the latter, preferably to 10 ppm by weight, or less, and saturate one ring of the two-ring molecular species, but insufficient to saturate the second ring of said molecular species, of the fused two-ring aromatic hydrocarbons components of said mixture of hydrocarbons, inclusive of naphthalenes, (2C) hydrocracking over a hydrocracking catalyst at hydrocracking conditions, the whole of the product liquid, previously hydrogenated as defined in (1C), supra, to crack fused multi-ring aromatic hydrocarbons containing three or more rings to the molecule and produce lower molecular weight lower boiling components, (3C) separating, suitably and preferably by distillation, the liquid product of said hydrocracking step as defined in (2C), supra, into blends which include (i) a blend rich in fused two-ring aromatic hydrocarbons boiling within a range of from about 400° F. to about 600° F., preferably from about 400° F. to about 575° F., and (ii) a blend rich in fused multi-ring hydrocarbons containing three or more rings to the molecule boiling within a range of from about 600° F. to about 750° F., preferably from about 575° F. to about 650° F., then (4C) contacting and reacting said blend rich in fused two-ring aromatic hydrocarbons as defined in (3C) (i), supra, with hydrogen, over a catalyst comprised of elemental iron and one or more alkali or alkaline-earth metals components at a temperature ranging from about 225° C. (437° F.) to about 430° C. (806° F.), preferably from about 250° C. (482° F.) to about 400° C. (752° F.), and hydrogen partial pressure ranging generally from about 0 psig to about 1000 psig, preferably from about 100 psig to about 600 psig, to selectively hydrogenate and crack said previously hydrogenated fused two-ring aromatic hydrocarbons to produce lower molecular weight, ultra high octane components suitable per se as gasoline or suitable as a gasoline blending component, and (5C) contacting and reacting said blend rich in fused multi-ring hydrocarbons containing three or more rings to the molecule as defined in (3C) (ii), supra, over (i) a hydrocracking catalyst at hydrocracking conditions, to crack the fused multi-ring aromatic hydrocarbon components and produce lower molecular weight lower boiling components suitable as motor gasoline, or motor gasoline blending components, or (ii) a hydrogenation catalyst at hydrogenation conditions, to hydrogenate the fused multi-ring aromatic hydrocarbon components and produce molecular components suitable as diesel, or diesel blending components, or (iii) a catalytic cracking catalyst at catalytic cracking conditions to crack the fused multi-ring aromatic hydrocarbon components and produce molecular components suitable as motor gasoline, or motor gasoline blending components.

The present invention in its more general aspects, or aspects as defined in (A), or in the specific combination of steps defined by (B) 2B(2BB), wherein a low boiling feed is hydrogenated and optionally hydrocracked, and the hydrogenated, or hydrogenated/ hydrocracked, product processed over an iron catalyst, is based in part on the discovery that the iron catalyst selectively ring opens partially hydrogenated fused two-ring aromatic hydrocarbon compounds while leaving paraffins and decalins essentially unconverted; that the iron catalyst has poor hydrogenation activity for hydrogenating fused two-ring aromatic compounds; and that some of the higher boiling fused multi-ring aromatic hydrocarbons substantially reduce the activity of the iron catalyst over time, this adversely affecting the activity maintainanced or life of the iron catalyst. For example, an LCCO feed contains relatively high concentration of naphthalenes, inclusive of naphthalene and alkyl substituted naphthalenes; generally naphthalenes containing from 1 to about 4 methyl groups in the molecule. The iron catalyst, it has now been found, will not effectively "ring-open" naphthalenes, and hence the reaction of a feed high in naphthalenes over an iron catalyst does not achieve the desired higher conversion levels possible with other types of feed components, e.g., tetralins. Moreover, the presence of the unreacted naphthalenes in the product suppresses the octane value of the product, and its octane is less than would be possible if more of the naphthalenes were ring-opened over the iron catalyst. Further it has been found that feeds, e.g., LCCO feeds, boiling above about 575° F., and especially above about 600° F., contain fused multi-ring aromatic hydrocarbons having greater than two rings in the molecule which react to reduce the activity maintainance of the iron catalyst because many of these compounds form other reaction product which for different reasons adversely affect the catalytic iron surface of the catalyst. In accordance with the process of this invention as defined in (A), or in the specific combination of steps defined by steps (B) 2B(2BB) therefore, feed streams rich in fused two-ring aromatic hydrocarbons, boiling below about 600° F., preferably below about 575° F., containing high concentrations of naphthalenes are first hydrogenated over conventional hydrotreating catalysts at conventional hydrogenating conditions, to desulfurize the feed and convert the naphthalenes to tetralins, and in an optional hydroisomerization step tetralins can be converted to other molecules by rearrangement, the molecularly rearranged molecules producing lower yields of methane when subsequently ring opened over the iron catalyst. The iron catalyst is thus employed in a subsequent step to ring-open the tetralins, and rearranged molecules, and convert the tetralin-enriched product or product enriched in tetralin and rearranged molecular species to alkylbenzenes; a product of higher octane than would otherwise have been possible to produce without said hydrogenation step. The iron catalyst in terms of its intrinsic activity is thus a poor hydrogenation catalyst per se, but readily ring-opens the saturated ring of tetralin without cracking the unsaturated ring, or aromatic portion of the molecule.

In the step of reacting a predominantly fused two-ring aromatic feed fraction, e.g., an LCCO feed fraction, over the iron catalyst two primary type operations are attractive: the first, a low pressure operation generally conducted at hydrogen pressures ranging from about 100 psig to about 450 psig, preferably from about 250 psig to about 350 psig, and the second a high pressure operation conducted at hydrogen pressures ranging from about 500 psig to about 1000 psig, preferably from about 500 psig to about 650 psig. In both, prior to reaction of the feed over the iron catalyst, the feed is preferably hydrogenated and reacted over a conventional hydrogenation catalyst at conventional hydrogenation conditions to remove sulfur, preferably to 10 ppm, or less, and then optionally hydrocracked; and, in the process wherein the product as a feed is to be treated over the iron catalyst at low pressures it is hydrogenated sufficient to convert the naphthalenes of the feed to tetralins, because a low pressure the iron catalyst does not have sufficient hydrogenation activity to hydrogenate the naphthalenes.

The iron catalyst, as disclosed in Application Ser. No. 760,894 now U.S. Pat. No. 4,664,777, supra, has the unique ability to ring open fused two-ring aromatic hydrocarbons to form high octane alkylbenzenes. The iron catalyst however also has the propensity to demethylate the alkylbenzenes to form methane and ultimately BTX, viz. benzene, toluene and xylenes; and undesirable result since excessive hydrogen is consumed, and the product reduced in value. Different types of operation are possible to reduce the formation of methane, one of which requires operation of the reactor containing the iron catalyst at low hydrogen pressure, and the other operation of the reaction containing the iron catalyst at high hydrogen pressures. Each offers certain advantages.

In low pressure operation, the hydrogenation of the feed over the hydrogenation catalyst is conducted at temperature, pressure and at hydrogen rate sufficient to reduce the level of sulfur to about 10 ppm, or less, and naphthalenes to about 5 weight percent, or less, preferably below about 3 weight percent, because the presence of naphthalenes in greater amounts inhibits the activity of the iron catalyst to ring open tetralins. Further, the passage of unreacted naphthalenes through the reactor containing the iron catalyst will result in a loss in yield of the highly desirable, high octane alkylbenzenes.

In reacting a hydrogenated feed rich in fused two-ring aromatic hydrocarbons over an iron catalyst at 350° C., 150 psig, it has been found that the yield of methane lines out at about 6 to 8 weight percent in achieving essentially 100 weight percent conversion of the tetralins on a once-through basis. At 330° C., 150 psig, the yield of methane when utilizing a similar feed lines out at about 2 to 3 weight percent with a tetralin conversion level of about 30 to 40 weight percent. In the latter case the product can be recycled to the reactor containing the iron catalyst to ultimately achieve essentially total conversion of the tetralin to alkylbenzenes with lower methane production than in the former case. This offers advantages, but requires a trade off between reactor capacity and methane formation.

In high pressure operations, a feed with fused two-ring aromatic hydrocarbons, inclusive of naphthalenes in concentration ranging from about 5 percent to about 25 percent, preferably from about 10 percent to about 20 percent, based on the weight of the feed, can be reacted over the iron catalyst at hydrogen pressures ranging from about 500 psig to about 1000 psig, preferably about 500 psig to about 650 psig, without excess methane formation. Methane yield is directly related to the hydrogenation activity of a catalyst, and albeit the iron catalyst is a poor hydrogenation catalyst at low hydrogen partial pressures, it improves sufficiently at high hydrogen partial pressures to hydrogenate naphthalenes. At low hydrogen pressures, e.g., 150 psig, data have shown that the iron catalyst has very limited capability to hydrogenate fused two-ring aromatics. However, at high hydrogen pressures the fused two-ring aromatics can be hydrogenated via use of the iron catalyst, but excessive amounts of methane are produced. Methane yields in the range of about 10 weight percent to 25 weight percent are produced at e.g., 500–1000 psig and 350° C. with a feed composition rich in tetralins, but containing less than 3 weight percent naphthalenes. It has been found however that by only partially hydrogenating the naphthalenes component of an LCCO feed in the hydrogenation reactor, the naphthalenes remaining in the product will inhibit or suppress methane formation on contact and reaction of the naphthalene-containing feed over the iron catalyst. An LCCO feed derived from petroleum thus normally contains about 60 to 70 weight percent naphthalenes, a portion of which can be hydrogenated over a conventional hydrogenation catalyst at conventional hydrogenation conditions to leave a concentration of naphthalenes in the product ranging from about 5 percent to about 25 weight percent, preferably 10 weight percent to about 20 weight percent, which product can be used as a feed to the reactor containing the iron catalyst.

Methane yield, in summary, is thus directly related to the hydrogenation function of the iron catalyst, which increases with increasing hydrogen pressure. The presence of naphthalenes however suppresses the formation of methane, and hence the naphthalenes can be used to suppress methane formation when the hydrogen pressure on the system employing the iron catalyst is increased. This effect it is believed, while not completely understood, can be explained; at least in part. The naphthalenes are believed to absorb on the hydrogenation sites required for formation of tetralins, and demethylation of the aromatic hydrocarbon molecules. By absorbing naphthalene to limit these sites, sites are no longer available for demethylation and hence methane yield is reduced. sufficient sites remain however for ring opening of the tetralins to produce alkylbenzenes.

In a second embodiment, as described in (B), supra, a wider boiling range sulfur and nitrogencontaining feed or feed boiling within a range of from 400° F. to about 750° F., preferably 400° F. to about 650° F., is split into two liquid components, (1) a first rich in fused two-ring aromatic hydrocarbons boiling below about 600° F., preferably below about 575° F., which first is conventionally hydrogenated, and then reacted over the iron catalyst to selectively crack the fused two-ring aromatic hydrocarbons, and (2) a second liquid rich in fused multi-ring aromatic hydrocarbons containing three or more rings in the molecule which is hydrogenated in conventional manner. A greater amount of higher octane gasoline is produced by splitting the feed in this manner, and then reacting the two liquid product fractions as described than would be possible by conventionally hydrocracking the whole feed. In treating the low boiling fraction in this manner the same benefits are obtained as discussed in connection with the treatment as defined in (A), supra. Added benefits are obtained, and difficulties avoided, by then hydrogenating the higher boiling liquid fraction over a conventional hydrogenating catalyst in conventional manner. The hydrogenated product contains molecular components directly useful as blending components for diesel fuel or heating oil. Alternately the hydrogenated product can be converted in a cat cracker over a cat cracking catalyst at cat cracking conditions to lower boiling, lower molecular weight components suitable as motor gasoline or motor gasoline blending components. Or, the hydrogenated product can be conventionally hydrocracked at hydrocracking conditions over a hydrocracking catalyst, in the presence of hydrogen, to produce motor gasoline or motor gasoline blending components.

The portion of the conventional LCCO fraction which boils above 575° F., particularly above 600° F., contains high concentrations of methylphenanthrenes. This fraction, generally 65 to 70 weight percent of the total of the feed components boiling above 575° F., can thus be hydrocracked suitably over a conventional hydrocracking catalyst to produce light gas ($C_4-$) and methylnaphthalenes, the latter of which can be recycled and reacted over the iron catalyst to produce alkylbenzenes. In another option the methylphenanthrenes can be partially hydrogenated and recycled to the "cat cracker" for further conversion to motor gasoline or fully hydrogenated to produce high octane diesel blending components. Data have shown that the activity maintainance of the iron catalyst is greatly improved when the final boiling point of the fused two-ring aromatic feed is reduced to 600° F., preferably 575° F. Typically, treating a 400°/575° F. LCCO feed converts greater than 95 weight percent of the fused two-ring aromatic hydrocarbon compounds in the LCCO without substantial debit to the process in terms of alkylbenzene production, while simultaneously the activity maintainance of the catalyst is greatly improved.

In a third embodiment, or embodiment as defined by (C), a wide boiling range sulphur-containing, and nitrogen-containing feed rich in fused multi-ring aromatic and hydroaromatic hydrocarbons containing two and three, or more, rings in the molecule, i.e., boiling within a range of from about 400° F. to about 750° F., preferably from about 400° F. to about 650° F., is processed in a manner which will convert a maximum amount of the feed components to high octane motor gasoline, or high octane motor gasoline components, mid-distillates and other fuels. The feed is conventionally hydrogenated, the liquid product therefrom conventionally hydrocracked, and the hydrogenated/hydrocracked product then split, suitably by distillation, into fractions other than $C_4-$ and light gas, and low octane gasoline suitable as a reformer feed, two liquid fractions, a first fraction rich in fused two-ring aromatic hydrocarbons boiling within a range of from about 400° F. to about 600° F., preferably 400° F. to about 575° F., and second fraction rich in fused multi-ring aromatic hydrocarbons having three or more rings to the molecule, boiling within a range of from about 600° F. to about 750° F., preferably 575° F. to about 650° F. The first fraction which is rich in fused two-ring aromatic hydrocarbons is then reacted over an iron catalyst, as previously described, and the second fraction which is rich in fused multi-ring aromatic hydrocarbons having three or more rings in the molecule is (i) then reacted over a conventional hydrocracking catalyst at conventional hydrocracking conditions, as previously described, to produce gasoline of improved octane in high yield, (ii) hydrogenated to produce diesel or high cetane blending products, or (iii) reacted over a conventional catalytic cracking catalyst at conventional catalytic cracking conditions to produce motor gasoline, or motor gasoline blending components.

To summary, three process schemes are thus generally useful in the practice of this invention, dependent on the nature of the available feed. In accordance with the first process scheme, (A) supra, a narrow boiling range feed boiling within a range of about 400° F./600° F., preferably 400° F./575° F., rich in fused two-ring aromatic hydrocarbons neither ring of which is hydrogen saturated, e.g., naphthalenes, is hydrogenated in a first step over a hydrogenation catalyst to desulfurize the feed and hydrogen saturate one of the unsaturated rings, but not the other, e.g., to produce tetralins. The product of the hydrogenation reaction is then stripped to remove the $H_2S$ generated in the first stage, and the product liquid then reacted in a second stage over the iron catalyst. In an optional step, the hydrogenated product can be hydroisomerized over a hydroisomerization catalyst to effect molecular rearrangement of the hydrogenated product so that on reaction of the hydroisomerized product over the iron catalyst lower yields of methane will be formed. The molecular arrangement can be (1) the formation of indanes from tetralins, (2) the formation of indanes or tetralins, or both, with repositioned methyl and other alkyl substituents, or (3) other yet unidentified species, which can be ring opened over the iron catalyst at lower methane yields. Ideally, it is desirable to maximize the amount of tetralins (or indanes) in the feed to the reactor containing the iron catalyst since the tetralin molecules are ring opened to form gasoline. Conversely, it is desirable to minimize the amount of naphthalenes, since these compounds are minimally hydrogenated over the iron catalyst, and indeed are absorbed on the iron catalyst to inhibit its ability to convert the tetralin molecules. in addition, it is preferable to limit hydrogenation of the naphthalenes to decalins since decalins are not converted over the fused iron catalyst and indeed are adsorbed on reaction sites to limitt the ring opening ability of the catalyst. The front end boiling point of the feed is maintained at 400° F. to avoid diluting the gasoline product with low octane unconverted components from the feed (e.g., paraffins), and the final boiling point is limited to 600° F., or 575° F., to exclude compounds which suppress the life of the iron catalyst. Thus, in conducting the hydrogenation reaction at low hydrogen partial pressures, i.e., 100 psig to 450 psig, the boiling range is limited and the naphthalene level is reduced to 5 percent or less, preferably 3 percent or less, based on the weight of the feed. Conversely, in conducting the hydrogenation reaction at high hydrogen partial pressures, i.e., 500 psig to 1000 psig, the naphthalene level is maintained at from about 10 percent to about 25 percent, based on the weight of the feed. The sulfur level is reduced to 10 ppm or less, based on the weight of the feed.

The hydrogenation catalyst is generally characterized as one wherein one or more Group VIB or Group VIII metals of the Periodic Table of the Elements (E. H. Sargent & Co., Copyright 1962 Dyna Slide Co.) is dispersed upon a porous inorganic oxide support, suitably alumina. Exemplary of such metals are molybdenum, tungsten, cobalt, nickel, and admixtures of such metals, suitably nickel-molybdenum, cobalt-molybdenum or nickelcobalt molybdenum.

Suitable hydrogenation conditions are defined in Table 1 as follows:

TABLE 1

| | Hydrogenation Conditions | |
|---|---|---|
| | Typical Range | Preferred Range |
| Temperature, °F. | 550–800 | 600–750 |
| Pressure, psig | 200–2000 | 500–1500 |
| LHSV, V/V/Hr. | 0.1–10 | 0.5–2.0 |
| Hydrogen Rate, SCF/B | 500–10,000 | 1000–5000 |

The hydrogenated liquid product from the hydrogenation reactor, after stripping to remove the $H_2S$, is preferably contacted in a second reactor over the iron catalyst at temperature ranging from about 225° C. (437° F.) to about 430° C. (752° F.), more preferably from about 250° C. (482° F.) to about 400° C. (752° F.) and more preferably from about 300° F. to about 375° C., and at hydrogen partial pressures ranging from about 0 psi to about 1200 psi, preferably from about 100 psi to about 500 psi, sufficient to ring open said fused multi-ring aromatic hydrocarbon compounds, or fused multi-ring hydroaromatic hydrocarbon compounds, or both, and produce higher boiling components suitable as motor gasoline, or motor gasoline blending components.

Some positive pressure of hydrogen is necessary in conducting reactions of the feed over the iron catalyst. The combination of temperature and hydrogen partial pressure are preferably such that most of the feed, at reaction conditions, is in vapor phase. Temperatures above about 430° C. (806° F.) generally should not be employed because excessive temperature causes cracking of the feed, which can lower liquid yields. At temperatures below about 225° C. (437° F.) on the other hand, the rate of reaction is generally too slow as to be practical. Total pressures are not critical, but generally range from about 0 psig to about 1500 psig, preferably from about 100 psig to about 1000 psig. Treat gas rates, based on hydrogen, range from about 500 to about 10,000 SCF/B, preferably from about 1000 to about 5000 SCF/B. Space velocities range generally from about 0.05 LHSV to about 20 LHSV, preferably from about 0.2 LHSV to about 5 LHSV.

The iron catalyst is constituted of elemental iron, modified with one or more alkali or alkaline-earth metals, or compounds thereof, sufficient to produce on contact with a feed at reaction conditions ring opening of the fused two-ring aromatics and hydroaromatics of the feed without significant cracking of paraffins or naphthenic hydrocarbon components of the feed. Preferably iron is present in the catalyst as the major component, or major metal component. The catalyst may be bulk (unsupported) iron, or iron dispersed upon a support. The bulk iron catalyst is preferred and it may be employed as essentially metallic iron in bulk, or as a bulk iron promoted or modified with alkali or alkaline-earth metals, or metal oxides such as sodium, potassium, cesium, magnesium, calcium, barium, or the like. The active iron catalyst, when a bulk iron catalyst, is preferably one which contains at least 50 percent elemental iron, preferably from about 70 percent to about 98 percent elemental iron, based on the weight of the catalyst. The iron catalyst, when a catalyst wherein the iron is distributed or dispersed upon a support, contains at least about 0.1 percent iron (measured as elemental iron), preferably from about 0.1 percent to about 50 percent iron, and more preferably from about 5 percent to about 25 percent iron, based on the total weight of the catalyst, and the supported metallic component, exclusive of the support component, or components, contains at least 50 percent iron (measured as elemental iron), and preferably from about 70 percent to about 98 percent iron.

A bulk or unsupported fused iron catalyst is preferred. A fused iron catalyst is one fused by heating and melting the iron, preferably with an alkali or alkaline-earth metal, or metals, the alkali or alkaline-earth metal, or metals, generally being present in concentrations ranging from about 0.01 percent to about 10 percent, preferably from about 0.2 percent to about 4 percent, based on the total weight of catalyst. Sodium, potassium, cesium, magnesium, calcium, and barium are the preferred alkali or alkaline-earth metals. Aluminum, principally as an oxide ($Al_2O_3$), or compound thereof is also a preferred promoter, or modifier, of the fused iron, and it is preferably contained in the catalyst in concentration ranging from about 0.01 percent to about 20 percent, more preferably from about 0.5 percent to about 5 percent calculated as aluminum oxide ($Al_2O_3$) based on the total weight of the catalyst. Other metals may also be used as promoters and/or modifiers, such metals including rhenium, nickel, cobalt, palladium, platinum, and copper. Such metals may be added to the catalyst alone or admixed one metal with another, or with other metals.

The iron based catalyst, as suggested, may also be supported; preferably upon an inorganic oxide support. Supports include, but are not limited to, the oxides of aluminum, silicon, boron, phosphorous, titanium, zirconium, calcium, magnesium, barium, and mixtures of these and other components. Other supports may include clays, such as bentonite, zeolites, and other alumino-silicate materials, e.g., montmorillionite. Additional supports may be selected from the group of refractory carbides and nitrides of the transition metals of Groups IVB, VB, VIB, VIIB, and Group VIII iron group metals. Alumina, magnesia, and mixtures of alumina and magnesia are preferred supports. The iron based catalysts are prepared by methods which include precipitation, coprecipitation, impregnation, vapor deposition, and the formation of metal complexes (i.e., metal carbonyl, etc.) and the like. The impregnation of a porous inorganic oxide support, such as alumina, with a solution of an iron salt with subsequent drying, calcination and reduction of the supported iron catalyst by contact and treatment of the catalyst with hydrogen or hydrogen and ammonia, or ammonia in admixture with another reducing gas, or gases, has been found to provide a highly active catalyst for selectively hydrogenating and hydrocracking the fused multi-ring aromatics and hydroaromatics to produce lower boiling, high octane components for use in motor gasoline. Impregnation of the support with iron, or iron and other metal promoters or modifiers, by the incipient wetness technique, or technique wherein the iron is contained in solution in measured amount and the entire solution absorbed into the support, subsequently dried, calcined, and activated is preferred. The supported iron catalyst is promoted or modified with alkali or alkaline-earth metals, or metal oxides such as sodium, potassium, cesium, magnesium, calcium, barium, or the like. The alkali or alkaline-earth metal, or metals or compounds thereof are generally employed in concentrations ranging from about 0.01 percent to about 10 percent, preferably from about 0.2 percent to about 4 percent, based on the total weight of metal, exclusive of the weight of the support. Sodium, potassium, cesium, magnesium, calcium, and barium, are the preferred alkali or alkaline-earth metals. Aluminum, principally as an oxide, or compound thereof, is also a preferred promoter, or modifier, and it is preferably employed in the catalyst in concentration ranging from about 0.01 percent to about 20 percent, more preferably from about 0.5 percent to about 5 percent, calculated as aluminum oxide ($Al_2O_3$), based on the total weight of metal, exclusive of the weight of the support. Rhenium, nickel, cobalt, palladium, platinum, and copper metals, or compounds thereof, can also be added to the catalyst as promoters or modifiers, these metals generally being added in concentrations ranging from about 0.01 percent to about 10 percent, preferably in concentration ranging from about 0.5 percent to about 2.5 percent, based on the weight of the supported component, exclusive of the weight of the support. After impregnation of the support, the metal impregnated support is dried generally at temperatures ranging from about 149° F. (65° C.) to about 536° F. (280° C.), preferably from about 176° F. (80° C.) to about 230° F. (110° C.), in circulating air, vacuum or microwave oven. The calcination is suitably conducted at temperatures ranging from about 572° F. (300° C.) to about 1202° F. (650° C.), preferably from about 842° F. (450° C.) to about 1022° F. (550° C.). The iron catalysts can be reduced, activated, or reactivated by contact with hydrogen, by sequential contact with hydrogen and ammonia or reduced and activated by contact with an admixture of ammonia and hydrogen or by contact with an admixture of ammonia and another reducing gas or gases.

Additional process schemes involve the processing of a wider boiling range feed, the first, (B), supra, requiring splitting the feed into two fractions, a first 400° F./600° F. feed fraction, or 400° F./575° F. feed fraction, which is processed in identical manner as the narrow boiling range feed, and a second feed fraction boiling at 600° F.+, preferably 575° F.+, which is hydrogenated to directly produce diesel fuel or heating oil; or a product suitable as a feed to a cat cracker to produce lower boiling components suitable as motor gasoline or motor gasoline blending components; or a product suitable as a feed to a hydrocracker to produce motor gasoline or motor gasoline blending components.

In another scheme for treating a wide boiling range feed containing fused multi-ring aromatic hydrocarbons having two, three and more rings to the molecule, the whole of the feed as described in (C), supra, is hydrogenated (1C), the liquid product therefrom is then hydrocracked (2C), and the liquid product then separated into two fractions (3C), a 400° F./600° F., preferably a 400° F./575° F. fraction, which is selectively hydrocracked over an iron catalyst (4C) and a 600° F./750° F., preferably a 575° F./650° F. fraction, which is hydrocracked, hydrogenated, or catalytically cracked (5C). The fraction which is hydrogenated is hydrogenated with a conventional hydrogenation catalyst at conventional hydrogenation conditions similar to those described in Table 1. In this reaction, the component of the feed containing the fused two-ring aromatics neither of which is saturated, e.g., naphthalenes, are partially hydrogenated to produce fused two-ring aromatics one ring of which is saturated and the other not saturated, e.g., tetralins. The feed is desulfurized and denitrogenated, and the product of the hydrogenation reaction as a feed, is then hydrocracked over a conventional hydrocracking catalyst at hydrocracking conditions as defined in Table 2. In such hydrocracking reaction, predominantly the fused multi-ring aromatics containing three or more rings are hydrocracked to lower molecular weight components. The product of this reaction is then separated into fractions which include two liquid fractions one a 400° F./600° F. or 400° F./575° F. fraction which is selectively ring opened over an iron catalyst (4C), and the second a 600° F./760° F. or 575° F./650° F. fraction which is (5C) (i) hydrocracked over a conventional hydrocracking catalyst at conditions as defined in Table 2; (5C) (ii) hydrogenated over the same catalyst at conditions shown in Table 1 and in the presence of minimal $H_2S$, or (5C) (iii) catalytically cracked over a conventional catalytic cracking catalyst. Tetralins are the primary molecules that are converted over the iron catalyst, at conditions previously defined to produce gasoline and gasoline blending components.

In ring-opening the tetralins of the feed over the iron catalyst in accordance with step (4C), the gasoline or gasoline blending components produced on distillation are of ultra high octane, typically ranging from about 108 to 112 RONC. This compares favorably to the octane of the hydrocrackate prepared in step (2C) which, even after reforming is about 100 RONC. Thus, it may be preferable to provide a separate distillation column in association with step (4C) to split or distill the product to produce an ultra high octane motor gasoline as well as an unconverted higher boiling stream (400° F.+) which can be recycled over the iron catalyst. The unconverted feed is suitable as a diesel fuel (and has a cetane number ranging from about 35 to 45).

Gasoline, gasoline blending components, mid-distillates and other fuels are produced in the second stage hydrocracker on contact of the hydrocracking catalyst at hydrocracking conditions with the feed consisting essentially of fused multi-ring aromatic hydrocarbon containing three or more rings in the molecule. Diesel or diesel blending components are the primary products.

For conducting hydrocracking operations, preferred hydrocracking catalysts are constituted generally of a crystalline zeolite cracking base upon which a minor proportion of a Group VIII metal hydrogenating components is deposited. Additional hydrogenated components may be selected from Group VIB for incorporation with the zeolite base. The zeolite cracking bases, often referred to as molecular sieves, are usually composed of silica, alumina and one or more exchangeable cations such as sodium, hydrogen, magnesium, calcium, rare earth metals, and the like. They are further characterized by crystal pores of relatively uniform diameter between about 4 and 14 Angstrom units. It is preferred to employ zeolites having a relatively high silica/alumina mole ratio between about 3 and 12, and even more preferably between about 4 and 8. The naturally occurring zeolites are normally found in a sodium form, an alkaline earth metal form, or mixed forms. Suitable zeolites found in nature include for example mordenite, stilbite, heulandite, ferrierite, dachiardite, chabazite, erionite, and faujasite. Suitable synthetic zeolites include for example the B, X, Y, and l crystal types or synthetic forms of the natural zeolites noted above, e.g., synthetic faujasite and mordenite. The preferred zeolites are those having crystal pore diameters between about 8–12 Angstrom units, wherein the silica/alumina mole ratio is about 4 to 6. A prime example of a zeolite falling in this preferred group is synthetic Y molecular sieve.

The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been "decationized." Y zeolites of this nature are more particularly described in U.S. Pat. No. 3,130,006.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. The preferred cracking bases are those which are at least about 10 percent, and preferably at least 20 percent, metal-cation-deficient, based on the initial ion-exchange capacity. A specifically desirable and stable class of zeolites are those wherein at least about 20 percent of the ion-exchange capacity is satisfied by hydrogen ions.

The active metals employed in the hydrocracking catalysts as hydrogenation components are those of Group VIII, i.e., iron, cobalt, nickel, ruthenium, rhodium, palladium, osmium, iridium, and platinum. In addition to these metals, other promoters may also be employed in conjunction therewith, including the metals of Group VIB, e.g., molybdenum and tungsten. The amount of hydrogenating metal in the catalyst can vary within wide ranges. Generally, any amount between about 0.05 percent and 30 percent by weight may be used. In the case of the noble metals, it is normally preferred to use about 0.05 to about 2 weight percent. The preferred method for incorporating the hydrogenating metal is to contact the zeolite base material with an aqueous solution of a suitable compound of the desired metal wherein the metal is present in a cationic form. Following addition of the selected hydrogenating metal or metals, the resulting catalyst powder is then filtered, dried, pelleted with added lubricants, binders or the like if desired, and calcined in air at temperatures of, e.g., 700°-1200° F. in order to activate the catalyst and decompose ammonium ions. Alternatively, the zeolite component may first be pelleted, followed by the addition of the hydrogenating component and activation by calcining. The foregoing catalysts may be employed in undiluted form, or the powdered zeolite catalyst may be mixed and copelleted with other relatively less active catalysts, diluents or binders such as alumina, silica gel, silica-alumina cogels, activated clays and the like in proportions ranging between 5 and 90 weight percent. These diluents may be employed as such or they may contain a minor proportion of an added hydrogenating metal such as a Group VIB and/or Group VIII metal.

Suitable hydrocracking conditions for conducting the hydrocracking operation can very within the ranges given in Table 2.

TABLE 2

| | Hydrocracking Conditions | |
|---|---|---|
| | Typical Range | Preferred Range |
| Temperature, °F. | 450-850 | 500-775 |

TABLE 2-continued

| | Hydrocracking Conditions | |
|---|---|---|
| | Typical Range | Preferred Range |
| Pressure, psig | 500-4000 | 1000-3000 |
| LHSV, V/V/Hr | 0.2-20 | 0.5-10 |
| Hydrogen Circulation, SCF/B | 2000-20,000 | 2000-10,000 |

In conducting the process described by reference to (C), two-ring aromatics are hydrogenated and hydroisomerized over conventional hydrocracking catalysts to produce molecular rearrangement of tetralin with low yields of methane, and this product as a feed is then ring-opened over the fused iron catalyst. In the process steps described by reference to (A) and (B) it is desirable to molecularly rearrange the tetralin at moderate conditions to avoid hydrocracking reactions, because paraffins, which are present are also hydrocracked to form lower molecular species which contaminate the product and lower product octane. The desired molecular rearrangement can be readily accomplished by the use of a small bed of conventional hydrocracking catalyst, e.g., HC-18 (Pd zeolite), in front or in advance of the bed of iron catalyst, operated at the same conditions as the bed of iron catalyst. Alternately, other catalysts can be so employed, e.g., noble metals on halogenated aluminas, exemplary of which is platinum on chlorided alumina.

In an alternate step in the process described by reference to (C), i.e., (5C) (iii), three-ring aromatics are catalytically cracked at catalytic cracking conditions to produce gasoline, or gasoline blending components. This reaction is carried to with a conventional "cat" cracking catalyst at conventional "cat" cracking conditions with, e.g., a zeolite cracking catalyst, encapsulated Y zeolite, silica-alumina or the like. Typical and preferred catalystic cracking conditions vary within the ranges given in Table 3.

TABLE 3

| | Catalytic Cracking Conditions | |
|---|---|---|
| | Typical Range | Preferred Range |
| Temperature, °F. | 900-1050 | 950-1025 |
| Pressure, psig | 10-50 | 15-40 |
| Residence Time, Sec. | 5-120 | 10-15 |
| Catalyst/Oil Ratio | 3-10 | 4-8 |

The invention will be more fully understood by reference to the following demonstrations and examples which present comparative data illustrating its more salient features. All parts are given in terms of weight except as otherwise specified.

A commercial BASF-R fused iron ammonia synthesis catalyst was employed in conducting the tests and demonstrations described in the text. The iron catalyst was received as prereduced, passivated small particles. This particulate catalyst was further ground and screened into smaller particles (14/35 Tyler mesh size) and then further reduced by contact with hydrogen prior to use. The chemical and physical properties of this catalyst on an as-received basis is given in Table 4, as follows:

TABLE 4

| Chemical Composition and Physical Characteristics of Commercial Fused Iron Catalyst (as received) | |
|---|---|
| | BASF-R Catalyst |
| I. Chemical Composition, Wt. % | |
| FeO | <1 |

TABLE 4-continued

| Chemical Composition and Physical Characteristics of Commercial Fused Iron Catalyst (as received) | |
|---|---|
| | BASF-R Catalyst |
| $Fe_2O_3$ | <1 |
| Free Fe | 90–95 |
| $Al_2O_3$ | 2.0–3.0 |
| $K_2O$ | 0.5–1.0 |
| CaO | 0.5–1.5 |
| $SiO_2$ | <0.5 |
| P | Trace |
| S as $SO_3$ | Trace |
| Chloride | <10 ppm |
| II. Physical Characteristics | |
| Bulk Density | 120 lb/cu ft in reduced form |

In conducting these runs, where an iron catalyst is used, a small I.D. stainless steel tubular reactor was employed, the feed and hydrogen having been cocurrently introduced into the bottom of the reactor and passed upwardly over a fixed bed of fused iron catalyst centered within the reactor. In introducing the feed, a single piston, positive displacement pump was used to introduce the feed, admixed with hydrogen, into the bottom of the reactor. A sandbath was employed to heat the reactor. The temperature of the reaction was measured by a thermocouple located on the reactor next to the catalyst bed, and controlled by the use of an automatic temperature controller in operative association with the sandbath heated externally by resistance heaters. The feed mixture was heated in transfer line prior to entry into the catalyst bed. Products exiting the reactor were condensed and collected in a receiver cooled to about 32° F., and a back pressure regulator was employed to maintain the desired pressure in the reactor.

The product collected from the reactor was analyzed by (1) a gas chromatograph (G.C.) distillation technique, (2) NMR to measure hydrogen content, (3) X-ray fluorescense to measure sulfur content, (4) high pressure liquid chromatography to measure aromatics content, (5) Antek procedure to measure nitrogen, and (6) mass spectrometry (MS) to analyze the off gas. Some selected products were analyzed by liquid mass spectrometry.

The feed of choice for conversion over the fused iron catalyst to make motor gasoline is one which is rich in tetralins or tetralin derivatives which can be converted over an iron catalyst at proper conditions to alkylbenzenes in high yields, providing a product of high octane value. Paraffins, decalins and naphthalenes at low concentrations are essentially unreactive in such reaction. this is demonstrated by the example immediately following.

EXAMPLE 1

A 20 cc charge of the BASF fused iron catalyst was charged to the tubular steel reactor and reduced at 400° C. for two hours in a flowing stream of hydrogen at atmospheric pressure. After reduction of the catalyst was completed the reactor pressure was increased to 150 psig, and the temperature brought to 330° C. A side stream from a hydrocracker rich in tetralins, was employed as a feed to the reactor containing the fused iron catalyst. The feed boiled within a range of 350°/550° F. and initially contained 29 wt. % tetralins. The feed, characterized in Table 5 was processed with hydrogen over the fused iron catalyst at 330°–350° F., 150 psig, 2500 SCF/B the gas rate and a feed rate of 0.5 to 1.5 LHSV.

TABLE 5

Feed: 350/550° F. Hydrocracker Side Stream
Conditions: 150 psig, 330° C.–350° C. (625–660° F.), 0.5–1.5 LHSV
2500 SCF/B $H_2$

| | 430° F.+ Conversion, wt. % | | | | | |
|---|---|---|---|---|---|---|
| Feed Components | 0 | 10 | 20 | 30 | 40 | 50 |
| Alkyl Benzenes | 37 | 42 | 48 | 53 | 58 | 60 |
| Tetralins | 29 | 22 | 16 | 11 | 6 | 3 |
| Paraffins | 9 | 10 | 10 | 10 | 10 | 11 |
| Decalins | 7 | 8 | 8 | 8 | 8 | 9 |
| Naphthalenes | 1 | 1 | 1 | 1 | 1 | 0.5 |

As shown by these data, obtained by liquid mass spectrometry, the tetralins concentration decreased linearly as 430° F.+ conversion was increased. At 50 wt. % 430° F.+ conversion only about 2–3 wt. % tetralins remained in the product. This represented a greater than 90% decrease of the feed tetralins. As also shown, the feed initially contained about 37 wt. % alkylbenzenes but as the 430° F.+conversion was increased the alkylbenzene concentration in the product increased linearly, this resulting from the ring opening of the tetralin type molecules. The paraffins and decalins components of the feed were unreacted, this indicating no ring opening of the decalins and no demethylation of the paraffins. The feed also contained 1–2 wt. % naphthalenes as an impurity, which did not react at these conditions, this indicating that the fused iron catalyst had little hydrogenation/dehydrogenation activity at these conditions. The primary reactions as indicated by the data are essentially as follows, to wit:

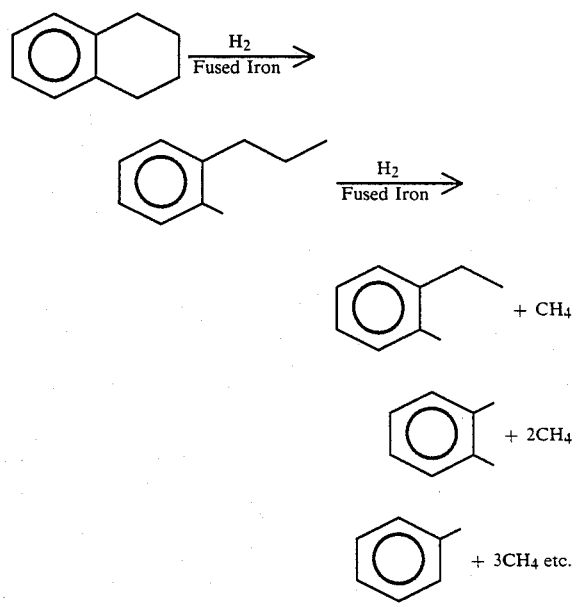

Apparently the tetralin molecule adsorbs onto the surface of the fused iron catalyst where the saturated ring is opened to form propyl toluene. Some of the propyl toluene is desorbed, but some remains attached to the iron surface where it is further demethylated to ethyl toluene. Some of the ethyl toluene is desorbed, but some remains adsorbed where it is further demethylated to xylenes, and other mononuclear aromatic hydrocarbon species. Although a minor pathway, in some instances (i.e., a high conversion once-through operation) the ring opened and partially demethylated tetralin can readsorb and be further demethylated. Tetralin derivatives which contain up to five methyl groups are also ring opened and demethylated.

The next example illustrates a specific refinement of the feed of choice for conversion over the fused iron catalyst such that it can be used to coproduce a highly aromatic high octane gasoline, and a high cetane value diesel fuel. Mid distillate feeds derived from the cat cracking of petroleum stocks [e.g., light cat cycle stocks (LCCO)], coal liquids as produced by the liquifaction of coal and the hydroconversion of bitumens and tar sands are especially suited for this purpose. In accordance with the process scheme exemplified, a mixed feed obtained from cat naphtha and light cat cycle stock of selected boiling range is first hydrogenated and desulfurized to provide a product useful as a low sulfur feed which can then be reacted with hydrogen over the fused iron catalyst to coproduce high octane gasoline and high cetane diesel fuels.

EXAMPLE 2

A feed constituted of a mixture of cat naphtha (HCN) and light cat cycle oil (LCCO) boiling within a range of 400°/575° F. can be hydrotreated at 325° C., 500 psig, 1500 SCF/B and 0.5 LHSV with $NiMo/Al_2O_3$ catalyst to reduce the sulfur level below 10 ppm, and the level of nitrogen below 5 ppm. Feeds of this type, of which the present was typical, generally contain 0.9–1.1 wt. % sulfur and 150–350 ppm nitrogen. The $H_2S$ is stripped from the product since sulfur can deactivate, and nitrogen can reversibly poison the fused iron catalyst.

Reference is made to Table 6 which identifies the hydrotreater feed composition, and the composition of the feed suitable for conversion in the fused iron catalyst reactor to coproduce high octane gasoline and diesel fuel.

TABLE 6

| Component. wt. % | Hydrotreater Feed | Total Hydrotreater Product | Diesel | Cut |
|---|---|---|---|---|
| Alkyl benzenes | 15 | 15 | | |
| Tetralins | 11 | 51 | 1 | |
| Naphthalenes | 52 | 7 | 2 | * |
| Naphthenes | 10 | 15 | 15 | |
| Paraffins | 12 | 12 | 12 | |

*30 wt. % 35–45 cetane

The hydrotreater feed, as shown in Table 6 contains 52 wt. % naphthalenes which are hydrogenated to the desired tetralins, though in this instance some overhydrogenation occurs which increases the naphthenes content from 10 to 15 wt. %. Treatment of the hydrotreater product over the fused iron catalyst will readily ring open the tetralins to make alkylbenzenes that boil in the gasoline boiling range 400° F.−. It should be noted that the tetralins in the feed will contain 0–5 alkyl groups, which e.g. in the case of LCCO derived from petroleum are predominately methyl groups. Those tetralins containing up to 3 methyl groups, will boil in the gasoline boiling range once ring opening has occurred. Those tetralins containing 4–5 methyl groups, on the other hand, must be demethylated to some degree after ring opening if the resulting alkylbenzenes are to boil in the gasoline boiling range.

In any regard, as shown in Table 6 it is the objective of this process to convert in excess of 90 % of the tetralins and naphthalenes to alkylbenzenes boiling in the gasoline boiling range, resulting in a net yield of gasoline of 67 wt. %, which has an RONC of 105–110 octane. At this level of conversion, there remains 30 wt. % unconverted material consisting of 90 wt. % naphthenes and paraffins which will boil in the diesel boiling range, which will have a cetane number of about 35–45. This material may also be suitable as a jet fuel, or jet fuel blending component. A net yield of 3 wt. % methane has been assumed for this calculation.

EXAMPLE 3

Methane yield has been found to be a key factor in the ring opening of tetralins over a fused iron catalyst. In conducting a run as described in Example 1, at 625° F. (330° C.) it was found that methane yield ranged from 2–3 wt. %. This level of methane yield correlates with the level of ring opening of tetralins to produce alkylbenzenes, wherein about 50 wt. % of the tetralins are converted to alkylbenzenes at the conditions described in Example 1. Higher levels of tetralin can be converted to alkylbenzenes by recycle of a tetralins rich recycle stream after product distillation.

Data have also shown that the level of conversion of the tetralins can be increased by increasing the temperature. Accordingly, the temperature level of the fused iron containing reactor was increased to 660° F. at differing 430° F.+ conversion levels, maintaining the other conditions of the reaction as described in Example 1.

The data given in Table 7 show methane yield in ring opening tetralin molecules at two different temperatures, viz. 625° F. and 660° F., respectively, at the conditions of Example 1 as relates to pressure, feed rate and gas velocity, to wit:

TABLE 7

| Methane Yield, wt. % at 150 psig | 430° F.+ Conversion, wt. % | | | |
|---|---|---|---|---|
| | 0 | 20 | 30 | 40 |
| 625° F. | 0 | 2.7 | — | — |
| 660° F. | 0 | 5.6 | 6.1 | 6.8 |

These data thus show that a 430° F.+ conversion level correlates directly with the level of ring opening or conversion of tetralins to alkylbenzenes. Methane yield is limited to 2–3 wt. % when operating at 625° F., at which conditions about 50 wt. % of the tetralins are ring opened. Methane yield can be limited by maintaining low conversion per pass with recycle of the unconverted tetralins to the fused iron reactor after distillation and separation of the product. Conversely, higher tetralins conversions can be obtained at higher temperature but with increased methane make.

Methane selectively can be controlled and reduced, at elevated pressure, by the addition to the feed of fused two ring compounds, the two rings of which are not saturated. The example immediately following thus demonstrates the use of naphthalenes added to or contained within the feed to regulate methane yield at higher pressure, e.g., 500 psig. This technique, unlike that previously demonstrated, offers an opportunity to lower methane yields without the requirement of maintaining the low conversion per pass of feed over the catalyst.

EXAMPLE 4

Runs were made employing the 350°/550° F. hydrocrackate side stream of the preceeding examples, except in this instance the feed stream was severely hydrotreated prior to contact and reaction over the iron catalyst by contact with a hydrogen-rich stream at 500° F., 1 V/V/Hr, 5000 SCF/B and 1000 psig, over a 0.6% platinum-on-halogenate alumina catalyst. For purpose of comparison, in certain of the runs, 1-methylnaphthalene was added to the hydrotreated feed prior to contact with the iron catalyst, and in other runs no such addition was made. Reference is made to Table 8.

The first two columns of data given in Table 8 were taken from Table 7, and show that $CH_4$ yield increased from 2.7 wt. % to 5.6 wt. % when temperature was increased from 625° F. to 660° F., at a 20 wt. % 430° F.+ conversion level. The data also show that when a feed similar to that employed in Example 3 was hydrotreated to reduce aromatics level, while holding all other process variables constant, the methane yield increased from 2.7 to 5.5 wt. %. A further increase in temperature, to 660° F., and pressure to 500 psig, resulted in higher methane yields, i.e., 7.7 wt. %. However, when 5 wt. % 1-methylnaphthalene was added to the feed, and this feed then fed to the reactor and ring opened at 625° F. and 500 psig, the methane yield was reduced to 3.8 wt. %. Even with further increase in temperature to 660° F., with 10% 1-methylnaphthalene added to the feed, there resulted in further decrease to 1 wt. % $CH_4$ yield.

TABLE 8

| | Methane Formation At Elevated Pressure | | | | | |
|---|---|---|---|---|---|---|
| | Feed: | | | | | |
| | 350/550° F. Hydrocracker Side Stream | | Hydrotreated 350/550° F. Hydrocracker Side Stream | | | |
| Press., PSIG | 150 | | 150 | 500 | 500(2) | 500(3) |
| Temp., °F. | 625 | 660 | 625 | 660 | 625 | 660 |
| $CH_4$ Yield, wt. %(1) | 2.7 | 5.6 | 5.5 | 7.7 | 3.8 | 1.0 |

(1)All data obtained at 20 wt. % 430° F.+ conversion level.
(2)5% 1-methylnaphthalene added to feed.
(3)10% 1-methylnaphthalene added to feed.

There are situations where low conversion per pass recycle operations can prove advantageous over high conversion single pass operations, and a phenomenon has been observed which further enhances the feasibility of such operation. Reference is made to Example 5.

EXAMPLE 5

The kinetics of the ring opening process on contact of aromatic and hydroaromatic feeds with fused iron catalysts indicates advantages for low conversion per pass recycle operation. As shown in Table 9 the disappearance of tetralins as indicated by 430° F. conversion at three different temperatures (625° F., 642° F. and 660° F.), at holding times ($LHSV^{-1}$) of 0.75 hrs., 1 hr. and 2 hrs., respectively, i snot first order with respect to holding time in the fused iron reactor. As temperature is increased from 625° to 660° F. the relationship becomes more first order, but significant deviation from first order behavior is still noted.

TABLE 9

| Fraction 430° F.+ Remaining | $LHSV^{-1}$, Hr. 0.75 | 1 | 2 |
|---|---|---|---|
| 625° F. | 0.87 | 0.82 | 0.78 |
| 642° F. | 0.85 | 0.80 | 0.68 |

TABLE 9-continued

| Fraction 430° F.+ Remaining | $LHSV^{-1}$, Hr. 0.75 | 1 | 2 |
|---|---|---|---|
| 660° F. | 0.78 | 0.65 | 0.50 |

Correlations have been developed from these data which show this deviation from first order behavior can be attributed to the production of a reversibly adsorbed byproduct which acts as a catalyst poison during the ring opening reaction. The rate equation for these reactions is:

$$\text{(Fraction of 430° F.+ Remaining)} = \frac{-k}{Kp}(1 + Kp/LHSV)$$

when k=430° F.+ conversion rate constant

Kp=adsorption constant for poison

The data indicate that the adsorption energy for the self generated poison is high showing strong affinity of the poison for the catalyst surface. It is evident from this data that operating at 1 hour holding time ($LHSV^{-1}$) gives almost the same 430° F.+ conversion as operating at 2 hours holding time. Thus, low conversion per pass recycle operation can be advantageous over high conversion once-through operation in many situations by minimizing the production of the catalyst poison.

The hydrogen partial pressure upon the reaction mixture strongly affects ring opening, the 430° F.+ conversion rapidly directly increasing as hydrogen partial pressure is increased up to a maximum, and thereafter declines as demonstrated by the following example.

EXAMPLE 6

A run was conducted wherein by reaction of the feed over the fused iron catalyst at 625° F. while varying the partial pressure of the hydrogen introduced into the reactor between 50 and 850 psi, measuring at the different pressures the fraction of the feed converted at 430° F. The rate constant was calculated using the equation given in Example 5. The results are given in Table 10.

TABLE 10

| | 430° F. Conversion Rate Constant at 625° F., $H_2$ Partial Pressure, PSI | | | | |
|---|---|---|---|---|---|
| 430° F. Conv. | 50 | 150 | 250 | 450 | 850 |
| Rate Const. | 0.07 | 0.55 | 0.85 | 0.55 | 0.30 |

These data show that the hydrogen partial pressure directly affects the 430° F.+ conversion (ring opening) of the feed, maximum conversion occurring in the 200–300 psi $ppH_2$ region. Below 200 psi $ppH_2$ the rate constant varies as the second power of the hydrogen partial pressure. Above 300 $ppH_2$ the rate constant is diminished strongly as the hydrogen partial pressure is increased. Additional data have shown that the rate constant varies as the first power of the $H_2$ treat gas rate at constant total reactor pressure.

From these data it is apparent that for optimal 430° F.+ conversion it is best to operate in the 200–300 psi $ppH_2$ range. If the temperature and/or pressure are adjusted to minimize methane yield then the gas rate can be increased to overcome the decrease in catalyst activity due to the less than optimal use of $H_2$ partial pressure.

EXAMPLE 7

Besides sulfur, high boiling hydrocarbons have been found to deactivate the fused iron catalyst at process conditions. Nitrogen too deactivates the catalyst, but only for so long as the nitrogen is present in the feed in contact with the catalyst. On removal of the nitrogen from the feed the activity of the catalyst will return without removal of the catalyst from on-oil treating conditions. Not so as regards sulfur and high boiling hydrocarbons. These can permanently deactivate the catalyst.

To demonstrate the catalyst deactivation effect of high boiling hydrocarbons two runs were conducted with hydrocracker sidestreams, the first with a feed containing less than 1 ppm sulfur, distilled to provide a high end boiling point of 570° F. (299° C.). This feed was tested over the fused iron catalyst at 500–1000 psig and 620°–660° F. and showed minimal deactivation. The second feed, from the same source, was poorly distilled to provide a high end boiling point of 750° F. (399° C.). Its sulfur level, however, was also less than 1 ppm. This feed when tested over a 500 hour period essentially completely deactivated the catalyst.

In the run conducted with the 570° F. high end point feed, near the end of the run nitrogen sufficient to provide a feed level of nitrogen at 400 ppm in the form of butylamine was added to the feed. The reaction rate was significantly depressed, but activity recovered when the butylamine was removed from the feed indicating reversible adsorption. Feeds containing less than about 25 ppm organic nitrogen can be effectively converted over the fused iron catalyst.

These results indicate high boiling hydrocarbons must be removed from the feed for best results. The end point of the feed should be no more than 600° F. and preferably no more than 575° F. The optimal feed for this process is a 400°/600° F. or 500°/575° F. boiling range feed containing 50–85 wt. % two-ring aromatics. LCCO, coal liquification mid distillates and mid distillates from the hydroconversion of heavy hydrocarbon feeds (bitumins, tar sands, etc.) of this boiling range are considered ideal for this process.

The process of this invention is capable of producing from a tetralin/naphthalene rich feed a high quality high octane product, even when the feed per se is one of low commercial value, e.g., a light cat cycle oil. The following example demonstrates the production of a high quality, ultra high octane product from an LCCO feed having an initial boiling point ranging between about 400° F. and 425° F.

EXAMPLE 8

A 400°/600° F. out of LCCO was hydrotreated to reduce the sulfur content to about 40 ppm, and the hydrogenated feed then reacted and ring opened over a fused iron catalyst, with hydrogen, at a temperature of 661° F., a pressure of 200 psig, a feed rate of 0.47 LHSV and at a hydrogen rate of 2700 SCF/B. A 375° F.− fraction and 375° F./430° F. fraction was distilled from the product, and an analysis made via mass spectrometer of each of the two fractions, as given in Table 11.

TABLE 11

| Identity of Fraction | 375° F.− | 375/430° F. |
|---|---|---|
| RONC | 110 | — |
| Composition. wt. % | | |
| Benzene/Toluene | 19.8 | 3.6 |
| $C_8$-$C_9$ Aromatics | 45.8 | 11.1 |
| $C_{10}$ Aromatics | 15.9 | 13.5 |
| $C_{11}$-$C_{12}$+Aromatics | 3.4 | 13.6 |
| Naphthalenes | — | 5.03 |
| Indanes | 3.8 | 35.4 |
| Styrene | 0.4 | 3.1 |
| Saturates | 11.1 | 14.7 |

A blended octane (with toluene) obtained on the 375° F.− cut showed an RONC of 110, molecular analysis showing that the 375° F.− fraction contained about 85 wt. % alkylbenzenes. A high percentage of the alkylbenzenes were $C_8$+ aromatics to which butane can be added to reach the required Reid vapor pressure for gasoline. It is evident that a process useful for the conversion of low value LCCO to ultra high octane gasoline is of much significance, as is the fact that butane a product of relatively low value can be upgraded.

Analysis of the 375°/430° F. cut indicates that the end point of the gasoline can be increased to 400° F. or more with very little decrease in octant quality. With the exception of the indanes this cut is very similar to the 375° F.− fraction except that the aromatics are a little heavier. The indanes and naphthalenes contained in this fraction boil have 400° F.

These data thus show that the naphtha resulting from this process is of very high quality and does not require catalytic reforming to reach high octane. The feed employed in the process is one which has an initial boiling point of about 400°–425° F. so that large amounts of tetralin and naphthalene can be included in the feed. On the other hand, the feed should not contain molecules boiling below 400°–425° F. inasmuch as the saturates in such feed would tend to contaminate the product naphtha to lower its octane. The gasoline produced should have an end point near 400° F., such that all of the tetralins that are ring opened will boil at or below the initial boiling point of the feed thereby minimizing contamination with feed molecules which would reduce octane.

EXAMPLE 9

As earlier shown, the feeds to the fused iron catalyst must first be hydrogenated to reduce sulfur, preferably below 10 ppm. The $H_2S$ formed from the feed sulfur must be stripped from the product before contacting the fused iron catalyst with the product, as feed, to avoid rapid deactivation of the catalyst. The hydrotreating catalyst must also hydrogenate the naphthalenes to tetralins since tetralins and not naphthalenes can then be ring opened over the fused iron catalyst. The fused iron catalyst has activity for naphthalene hydrogenation only at high pressures, e.g., 500 psig, and greater.

A commercially available $CoNiMo/Al_2O_3$ catalyst was used to hydrotreat a HCN/LCCO blend at the conditions shown on Table 12. Pressures in the range of 500–750 psig were employed. The results show that the desired low levels of sulfur and nitrogen can be attained at all pressure levels. However, pressures of 750 psig are most effective in providing a product having low levels of naphthalenes (7.3 wt. %) for use as a feed to the fused iron reactor. Even better performance is attained if the end point is reduced from 600° F. to 575° F.

TABLE 12

| | |
|---|---|
| Feed: | 400/600° F. HCN/LCCO |
| Conditions: | 0.5 LHSV, 2000 SCF/B $H_2$, 625° F. |

TABLE 12-continued

| Pressure, psig | 500 | 650 | 750 | Feed |
|---|---|---|---|---|
| Sulfur, ppm | 10–20 | 10–20 | 10–20 | 0.91[1] |
| Nitrogen, ppm | <5 | <5 | <5 | 183 |
| Saturates, wt. % | 22.3 | 24.3 | 26.4 | 15.3 |
| 1-Ring Aromatics, wt. % | 66.1 | 66.8 | 66.3 | 20.3 |
| 2-Ring Aromatics, wt. % | 11.6 | 8.9 | 7.3 | 64.4 |

[1]wt. % sulfur

The following Example 10 is exemplary of a flow plan, or process scheme, for producing high octane gasoline, and other fuels from a fused milti-ring aromatic hydrocarbon feed constituted of an admixture of 400°/430° F. HCN and 430°/725° F. LCCO.

EXAMPLE 10

The HCN/LCCO feed is first distilled, the 575°/725° F. fraction rejected (for use as heating oil) and the 400°/575° F. fraction recovered. Most of the fused three-ring aromatic hydrocarbons are thus rejected by the distillation, this fraction containing most of the iron catalyst deactivators, and the dibenzothiophene (DBT) molecules which are difficult to desulfurize. The 400°/575° F. cut is then hydrogenated over a nickel-molybdenum or cobalt-nickel-molybdenum catalyst at 0.5 LHSV, 800 psig (total) and 1000 SCF/B of hydrogen to reduce the sulfur level of the feed below 10 ppm, and saturate one of the two aromatic rings of the fused two-ring aromatic hydrocarbon molecules, but not the other. The product from the hydrogenation is then steam stripped to remove the sulfur as $H_2S$.

The effluent from the stripper is contacted and reacted over a BASF fused iron catalyst at 0.65 LHSV, 400 psig hydrogen pressure, at 2500 SCF/B $H_2$ treat gas rate to ring open the tetralin and form high octane gasoline. The product is then distilled in a second distillation column to recover alkylbenzenes in a 400° F.− mogas fraction, and a 400° F.+ diesel fraction. A heartcut (400°/525° F.) fraction is recycled. The unconverted tetralins in the heartcut fraction are recycled to the fused iron reactor (2:1 recycle to fresh feed) where the tetralins are converted at low conversion/pass (30%) to produce low yields of methane. The bottom from the distillation column contains, as suggested, 525° F.+ unconverted saturates with low levels of aromatics which make this fraction useful as a diesel blend stock (35–45 cetane number and higher). The unconverted tetralins will tend to build up in a heartcut which is recycled to the fused iron reactor. Some amount of purge will be required of the stream to prevent buildup of unconverted saturates. The endpoint of the mogas and the initial boiling point of the diesel can vary somewhat, but generally will be 400° F. or higher.

Although this process utilizes HCN/LCCO as the feed, any highly aromatic stream with a 400°/575° F. boiling range will be suitable for this process. This includes coal liquification mid-distillates, steam cracker gas oils and mid-distillates from the hydroconversion of bitumens and tar sands. This process can also be utilized as an add on to a hydrocracker. The 400°/575° F. sidestream is low in sulfur and contains high concentrations of tetralins. This material can be fed directly into the fused iron reactor for ring opening of the tetralins. A distillation column will be needed to remove the high octane gasoline and produce a recycle stream and/or product diesel.

It is not mandatory that recycle operation be employed. The reactor temperature of the fused iron catalyst can be increased to 660° F. to obtain greater than 90% conversion of tetralins, albeit at the expense of higher $CH_4$ yields.

A feedstock effect has been observed between fused two-ring aromatic hydrocarbons derived, on the one hand, from a process wherein a feedstock was cracked over a non-metal containing cracking catalyst, e.g., a zeolite catalyst, and, on the other hand, from a process wherein the product of the above process (LCCO) was hydrocracked over a zeolite catalyst that contained a hydrogenation metal component, e.g., Pd as the hydrogenating metal. The following exemplifies the ringopening behavior of an LCCO feed constituted essentially of fused two-ring aromatic compounds which had been formed over a zeolite cracking catalyst and hydrogenated over a $CoNiMo/Al_2O_3$ catalyst, when processed over a fused iron catalyst, and the data obtained from this run are contrasted with data obtained in a similar run except that the feed was processed over an HC-18 Pd-zeolite hydrocracking catalyst prior to reaction over the fused iron catalyst. A feed of the former type is typical of one which may be utilized in the processes defined by processes (A) and (B), supra, as typically might be employed in a grass roots refinery. This feed is represented in the following example by a hydrotreated LCCO, referred to below as "H/T LCCO". A feed of the latter type, i.e., a hydrocracked feed, on the other hand, is represented by a hydrocracked sidestream referred to below as "H/C Sidestream".

EXAMPLE 11

Runs were made with two feeds to determine the ring-opening behavior over a fused iron catalyst of the fused two-ring aromatic hydrocarbon components thereof, (1) one LCCO feed having been obtained as a product of a reaction of a feedstock over a cracking catalyst which did not contain a metal hydrogenation component (H/T LCCO), (2) the other a feed obtained by hydrocracking a LCCO over a HC-18 (Pd/zeolite) catalyst. Certain feed characteristics, the conditions at which each of the runs were carried out, and data obtained at these conditions, are given in Table 13.

TABLE 13

| Feed | H/T LCCO (400° F./575° F.) | | | H/C Sidestream (350° F./550° F.) |
|---|---|---|---|---|
| Feed Composition | | | | |
| Sulfur, ppm | 1 | | | <1 |
| Nitrogen, ppm | 1 | | | 12 |
| Saturates, wt. % | 24.4 | | | 27.4 |
| One Ring Aromatics, wt. % | 64.4 | | | 69.9 |
| Two Ring Aromatics, wt. % | 10.5 | | | 2.7 |
| Three Ring Aromatics, wt. % | 0.7 | | | — |
| Distillation (ASTM) | | | | |
| $C_5$/180° F. | 0 | | | 0.46 |
| 180/320° F. | 0.01 | | | 7.77 |
| 320/430° F. | 8.11 | | | 49.74 |
| 430/500° F. | 40.86 | | | 35.89 |
| 500/550° F. | 30.90 | | | 5.89 |
| 550° F.+ | 0.12 | | | 0.25 |
| Run Conditions | | | | |
| Pressure, psig | 150 | 300 | 500 | 150 |
| Temp., °F. | 660 | 642 | 651 | 660 |
| LHSV | 1.5 | 0.5 | 0.5 | 1.5 |
| SCF/B $H_2$ | 2500 | 2500 | 4000 | 2500 |
| $CH_4$ Yield, wt. % | 4.3 | 5.7 | 8.7 | 5.5 |
| 430° F.+ Conversion, | 8.5 | 14.5 | 26.8 | 24.0 |

TABLE 13-continued

| Feed | H/T LCCO (400° F./575° F.) | H/C Sidestream (350° F./550° F.) |
|---|---|---|
| wt. % | | |

These data show that the fused two-ring aromatic hydrocarbon components of the hydrotreated LCCO feed were more difficult to ring-open and produced higher yields of methane than those of the hydrocracker sidestream. Thus, at generally corresponding 430° F.+ conversion levels, i.e., 24.0 wt. % for the H/C Sidestream and 26.8 wt. % for the H/T LCCO, the methane yield was 5.5 wt. % for the hydrocracker sidestream; i.e., about a 25% improvement. Conversely, at corresponding methane yields, the conversion level of the hydrotreated LCCO was considerably less than that of the hydrocracker sidestream. It is believed that this is due to differences between the fused two-ring aromatic hydrocarbon components of the two different feeds, and their concentrations in the feeds. The hydrotreated LCCO feed is richer in tetralins the saturated ring portion of which, in the fused iron reaction, breaks down stepwise to form, e.g., diethyl benzene, ethyl toluene, m-xylene, toluene and benzene. Each step liberates a molecule of methane. The hydrocracker sidestream product, on the other hand, is richer in indanes. The saturated ring of the indane molecule, like that of tetralin, is also cracked to form alkylated benzenes, but lesser methane is formed. The upshot of this is that a hydrogenated feed such as produced in step 1A or step 2B of (A) or (B), supra, can be pretreated over a hydroisomerization catalyst, as a consequence of which less methane will be produced when the pretreated feed is reacted over the fused iron catalyst. This property of the feed to produce less methane is independent of the effect of the low hydrogen pressure and high hydrogen pressure operations, respectively, employed in reacting a feed over the fused iron catalyst.

The following data further show that a process employing a reaction zone containing a hydroisomerization catalyst in front of the reaction zone containing the fused iron catalyst will modify the fused two-ring aromatic compounds such that they are less susceptible to methane formation.

EXAMPLE 12

In an additional run a 400°/575° F. LCCO feed was contacted and reacted at the conditions given in Table 14, (1) over a fused iron catalyst per se (Column 2) (2) over an admixture of $Al_2O_3$ and HC-18 (Pd/zeolite) catalyst, in equal weight concentration prior to contact with the fused iron catalyst (Column 3). In the latter reaction, the $Al_2O_3$/HC-18 admixture was located at the inlet side of the reactor and constituted 30 wt. % of the total catalyst of the reactor, and the fused iron catalyst was located at the outlet side of the reactor and constituted 70 wt. % of the total catalyst of the reactor.

TABLE 14

| Catalyst | Fused Iron | $Al_2O_3$/HC-18 With Fused Iron |
|---|---|---|
| Conditions | | |
| Pressure, psig | 500 | 500 |
| Temp., °F. | 645 | 641 |
| LHSV | 0.5 | 1.0 |
| $H_2$ Gas Rate, SCF/B | 4000 | 4000 |
| Yields, wt. % | | |
| $CH_4$ | 10.3 | 3.2 |
| $C_5$/400° F. | 21.0 | 20.2 |
| 400° F.+ | 70.4 | 76.1 |

The following data show that recycle of unconverted tetralins in the product can be employed to reduce methane yield when a feed is reacted over the iron catalyst. It has thus been found that product molecules (alkylbenzenes) can be readsorbed upon the iron catalyst and further demethylated. However, this effect can be reduced and methane yield lowered by recycle of a portion of the product with the feed. This suggests that competitive adsorption of the recycle tetralin molecules inhibits readsorption of the product alkylbenzenes.

EXAMPLE 13

Hydrotreated LCCO feed as employed in Example 11 was used in runs to simulate recycle operations as follows: the H/T LCCO feed, reference being made to Table 15, was subjected to reaction over the fused iron catalyst in a series of operations, (1) a first pass operation wherein no 400° F.+ recycled product was added to the fresh feed, (2) a second pass operation wherein the fresh feed and 400° F.+ recycled product from (1) were admixed in a 1:1 weight ratio, (3) and third pass operations wherein the fresh feed and 400° F.+ recycled product from (2) were admixed in each instance, in a 1:2 weight ratio. For comparative purposes, the fresh feed was treated without admixture with 400° F.+ recycle product at more severe conditions to attain approximately the same conversion to motor gasoline and these runs are described in Table 15 as once through operations, viz. "O.T.". The conditions for each of these runs is given in Table 15, and comparisons between yields of methane and motor gasoline are made on total feed and fresh feed basis.

TABLE 15

| | 1st Pass | 2d Pass | | 3rd Pass | | | |
|---|---|---|---|---|---|---|---|
| Fresh H/T BR LCCO Feed, wt. % | 1.0 | 1.0 | | 1.0 | | 1.0 | |
| Recycled Product wt. % | 0.0 | 1.0 | | 2.0 | | 2.0 | |
| Conditions | | | O.T | | O.T | | O.T |
| Pressure, psig | 500 | 500 | 500 | 500 | 500 | 500 | 500 |
| Temp. °F. | 640 | 610 | 651 | 616 | 645 | 635 | 660 |
| LHSV | 1 | 0.5 | 1.5 | 0.5 | 0.5 | 0.5 | 1.0 |
| $H_2$ Gas Rate SCF/B | 4000 | 4000 | 4000 | 4000 | 4000 | 4000 | 5000 |
| Yields on Total Feed, wt. % | | | | | | | |
| $CH_4$ | — | 3.5 | — | 3.8 | — | 9.3 | — |
| $C_5$/400° F. | — | 13.1 | — | 9.2 | — | 19.3 | — |
| Yields on Fresh Feed, wt. % | | | | | | | |
| $CH_4$ | 5.5 | 6.3 | 8.8 | 8.0 | 10.3 | 13.5 | 17.1 |
| $C_5$/400° F. | 12.1 | 19.2 | 19.6 | 22.0 | 21.0 | 32.1 | 27.8 |

As shown in Table 15, in the first pass operation a yield of 5.5 wt. % methane was obtained at 12.1 wt. % conversion to motor gasoline, based on fresh feed. In the second pass operation, with a 1:1 ratio of 400° F.hu + recycle product and fresh feed, a yield of 6.3 wt. % methane was obtained at 19.2 wt. % conversion to motor gasoline, based on fresh feed. In the once through operation a yield of 8.8 wt. % methane was obtained at a closely corresponding conversion level, viz. 19.6% wt. % conversion to motor gasoline. These results show that recycle operations resulted in a 28% reduction in methane yield compared to once through operation.

The product from the second recycle operation was distilled to recover the 400° F.+ product, and this product was blended in a 2:1 ratio with fresh feed for conducting the third pass operations. The results of this operation are compared with once through operation at two different levels of conversion to motor gasoline. The data given in Table 15 for the third pass operations show that recycle operation reduced methane yield by more than 22%. These data, an d model compound ring opening over fused iron data show that product molecules are readsorbed by the iron and are further demethylated. However, by the use of recycle to produce partial conversion per pass product molecules can be withdrawn from the reaction zone before readsorption and consequent demethylation.

It is apparent that various modifications and changes can be made without departing the spirit and scope of the invention.

Having described the invention, what is claimed is:

1. A process for the production of high octane gasoline, or high octane gasoline blending components from a sulfur-containing feed rich in molecular species characterized as fused two-ring aromatic hydrocarbons, inclusive of naphthalenes, boiling within a range of from about 400° F. to about 600° F., which comprises hydrogenating said feed, in a first reaction zone, over a hydrogenation catalyst at hydrogenation conditions sufficient to desulfurize the feed and saturate one ring of said fused two-ring aromatic hydrocarbons but insufficient to saturate the second ring of said molecular species, to form tetralins, and then contacting, in a second reaction zone, said hydrogenated product as a feed, in the presence of hydrogen, over a catalyst comprised of elemental iron and one or more alkali or alkaline-earth metals components at temperature ranging from about 437° F. (225° C.) to about 806° F. (430° C.), and hydrogen partial pressure ranging to about 1000 psig to selectivity hydrogenate and crack said previously hydrogenated fused two-ring aromatic hydrocarbons to form alkylbenzenes, producing a product suitable per se as high octane gasoline, or gasoline blending components.

2. The process of claim 1 wherein the hydrogenation conducted in said first reaction zone is carried out by reaction of the 400° F./600° F. feed over a Group VIB or Group VIII metal catalyst at temperature ranging from about 550° F. to about 750° F., pressure ranging from about 250 psig to about 1000 psig, flow rate ranging from about 0.25 V/V/Hr. To about 5.0 V/V/Hr., and hydrogen rate of from about 500 SCF/B to about 7500 SCF/B to saturate one ring of said fused two-ring aromatic hydrocarbons and produce a product which is employed as a feed and reacted over the iron catalyst.

3. The process of claim 2 wherein the hydrogenation catalyst of said first reaction zone is comprised of molybdenum, tungsten, cobalt, nickel, nickel-molybdenum, cobalt-molybdenum, or the like, supported on alumina, and the hydrogenation reaction is conducted at temperature ranging from about 550° F. to about 750° F., at pressures ranging from about 250 psig to about 1000 psig, flow rate ranging from about 0.25 V/V/Hr. to about 5.0 V/V/Hr., and at hydrogen rates ranging from about 500 SCF/B to about 7500 SCF/B.

4. The process of claim 1 wherein the hydrogenated product contacted and reacted as a feed over the iron catalyst of said second reaction zone is conducted at temperature ranging from about 482° F. (250° C.) to about 752° F. (400° C.), and at hydrogen partial pressure ranging to about 600 psig.

5. The process of claim 1 wherein the hydrogenated product of said first reaction zone, as a feed is reacted over the iron catalyst of said second reaction zone at hydrogen pressures ranging from about 100 psig to about 450 psig, and in the presence of naphthalenes in concentration ranging up to about 5 percent, based on the weight of the feed.

6. The process of claim 5 wherein the hydrogen pressure ranges from about 250 psig to about 350 psig, and the concentration of naphthalenes ranges up to about 3 percent.

7. The process of claim 1 wherein the hydrogenated product of said first reaction zone, as a feed, is reacted over the iron catalyst of said reaction zone at hydrogen pressures ranging from about 500 psig to about 1000 psig, in the presence of naphthalenes in concentration ranging from about 5 percent to about 25 percent, based on the weight of the feed.

8. The process of claim 7 wherein the hydrogen pressure ranges from about 500 psig to about 650 psig, and the concentration of naphthalenes ranges from about 10 percent to about 20 percent.

9. The process of claim 1 wherein the product of the reaction over the iron catalyst is separately fractionated to recover an ultra high octane gasoline, or gasoline blending component.

10. The process of claim 1 wherein the hydrogenated product, prior to contact in the second reaction zone with the iron catalyst, is contacted with a hydroisomerization catalyst at hydroisomerization conditions sufficient for rearrangement of the molecular species of said hydrogenated product, inclusive of tetralins, to form indanes and other molecular species, and increase the concentration of indanes and other molecular species, in the product which is then employed as a feed to said second reaction zone.

11. The process of claim 1 wherein the product of said hydroisomerization reaction, as a feed, is reacted over the iron catalyst of said second reaction zone at hydrogen pressures ranging from about 100 psig to about 450 psig, and in the presence of naphthalenes in concentration ranging up to about 5 percent, based on the weight of the feed.

12. The process of claim 11 wherein the hydrogen pressure ranges from about 350 psig, and the concentration of naphthalenes ranges up to about 3 percent.

13. The process of claim 10 wherein the product of said hydroisomerization reaction, as a feed, is reacted over the iron catalyst of said reaction zone at hydrogen pressures ranging from about 500 psig to about 1000 psig, in the presence of naphthalenes in concentration ranging from about 5 percent to about 25 percent, based on the weight of the feed.

14. The process of claim 13 wherein the hydrogen pressure ranges from about 500 psig to about 650 psig, and the concentration of naphthalenes ranges from about 10 percent to about 20 percent.

15. The process of claim 10 wherein the product of the reaction over the iron catalyst is separately fractioned recover an ultra high octane gasoline, or gasoline blending component.

16. The process of claim 1 wherein the iron catalyst with which the hydrogenated product is contacted and reacted as a feed, within said second reaction zone is characterized as (i) a bulk iron catalyst which contains at least 50 percent elemental iron, based on the weight of the catalyst, and the catalyst is modified with one or more alkali or alkaline-earth metals, or (ii) an iron catalyst wherein the iron is dispersed upon an inorganic oxide support, the catalyst containing at least about 0.1 percent iron, based on the total weight of the catalyst, the supported metallic component containing at least 50 percent iron, exclusive of the support component, or components, of the catalyst, and the iron is modified with one or more alkali or alkaline-earth metals.

17. The process of claim 16 wherein the iron catalyst with which the feed and hydrogen are contacted at reaction conditions, when a bulk iron catalyst, is one which contains at least 70 percent to about 98 percent elemental iron.

18. The process of claim 17 wherein the catalyst with which the feed and hydrogen are contacted at reaction conditions is modified with one or more alkali or alkaline-earth metals in concentration ranging from about 0.01 percent to about 10 percent, and aluminum in concentration ranging from about 0.01 percent to about 20 percent.

19. The process of claim 1 wherein the iron catalyst with which the hydrogenated product is contacted and reacted as a feed, with hydrogen, is a fused iron catalyst.

20. The process of claim 1 wherein the iron catalyst with which the hydrogenated product contacted and reacted as a feed, with hydrogen, is a supported iron catalyst which contains from about 70 percent to about 98 percent iron, exclusive of the support component, or components.

21. The process of claim 20 wherein the supported iron catalyst is modified with one or more alkali or alkaline-earth metals in concentration ranging from a bout 0.01 percent to about 10 percent, and aluminum in concentration ranging from about 0.01 percent to about 20 percent.

22. A process for the production of high octane gasoline, or high octane gasoline blending components from a wide boiling range sulfur-containing feed composition constituted of fused multi-ring aromatic hydrocarbons containing two, and three or more rings in the molecule, which comprises splitting the feed into two liquid feed fractions, (a) a first feed fraction constituting a blend rich in fused two-ring aromatic hydrocarbons, inclusive of naphthalenes, boiling within a range of from about 400° F. to about 600° F., and (b) a second feed fraction constituting a blends rich in aromatic hydrocarbons containing three or more rings in the molecules and boiling within a range of from about 600° F. to about 750° F., hydrogenating in a first reaction zone over a hydrogenation catalyst at hydrogenation conditions said first feed fraction (a), sufficient to desulfurize the feed and saturate one ring of the fused two-ring aromatic hydrocarbon components of the feed, but insufficient to saturate the second ring of said molecular species, to form tetralins, and then contacting in a second reaction zone said hydrogenated product as a feed, in the presence of hydrogen, over a catalyst comprised of elemental iron and one or more alkali or alkaline-earth metals components at a temperature ranging from about 437° F. (225° C.) to about 806° F. (430° C.), and hydrogen partial pressure ranging to about 1000 psig, to selectively hydrogenate and cracking said previously hydrogenated fused two-ring aromatic hydrocarbons to produce lower molecular weight, higher octane components suitable per se as gasoline, or gasoline blending components, and contacting, in a said third reaction zone, said second feed fraction rich in fused multi-ring aromatic hydrocarbons containing three or more rings to the molecule over a hydrogenation catalyst, in the presence of hydrogen at hydrogenation conditions, to hydrogenate said fused multi-ring aromatic hydrocarbon components to produce heating oil, diesel fuel, both heating oil and diesel fuel, or feedstock suitable as a hydrocracking feed or cat cracking feed for conversion to gasoline, or gasoline blending components.

23. The process of claim 22 wherein the hydrogenation conducted in said first reaction zone is carried out by reaction of the 400° F./600° F. feed over a Group VIB or Group VIII metal catalyst at temperature ranging from about 550° F. to about 750° F., pressure ranging from about 250 psig to about 1000 psig, flow rate ranging from about 0.25 V/V/Hr. to about 5.0 V/V/Hr., and hydrogen rate of from about 500 SCF/B to about 7500 SCF/B to saturate one ring of said fused two-ring aromatic hydrocarbons and produce a product which is employed as a feed and reacted over the iron catalyst.

24. The process of claim 23 wherein the hydrogenation catalyst of said first reaction zone is comprised of molybdenum, tungsten, cobalt, nickel, nickel-molybdenum, cobalt, molybdenum, or the like, supported on alumina, and the hydrogenation reaction is conducted at temperatures ranging from about 550° C., to about 750° F. at pressures ranging from about 250 psig to about 1000 psig, flow rate ranging from about 0.25 V/V/Hr. to about 5.0 V/V/Hr., and at hydrogen rates ranging from about 500 SCF/B to about 7500 SCF/B.

25. The process of claim 22 wherein the hydrogenated product contacted and reacted as a feed over the iron catalyst of said second reaction zone is conducted at temperature ranging from about 482° F. (250° C.) to about 752° F. (400°), and at hydrogen partial pressure ranging to about 600 psig.

26. The process of claim 22 wherein the hydrogenated product of said first reaction zone, as a feed, is reacted over the iron catalyst of said second reaction zone at hydrogen pressures ranging from about 100 psig to about 450 psig, and in the presence of naphthalenes in concentration ranging up to about 5 percent, based on the weight of the feed.

27. The process of claim 26 wherein hydrogen pressure ranges from about 250 psig to about 350 psig, and the concentration of naphthalenes ranges up to about 3 percent.

28. The process of claim 22 wherein the hydrogenated product of said first reaction zone, as a feed, is reacted over the iron catalyst of said reaction zone at hydrogen pressures ranging from about 500 psig to about 1000 psig, in the presence of naphthalenes in concentration ranging from about 5 percent to about 25 percent, based on the weight of the feed.

29. The process of claim 28 wherein the hydrogen pressure ranges from about 500 psig to about 650 psig, and the concentration of naphthalenes ranges from about 10 percent to about 20 percent.

30. The process of claim 22 wherein the product of the reaction over the iron catalyst is separately fractionated to recover an ultra high octane gasoline, or gasoline blending component.

31. The process of claim 22 wherein the iron catalyst with which the hydrogenated product is contacted and reacted as a feed, with hydrogen, in second reaction zone is characterized as (i) a bulk iron catalyst which contains at least 50 percent elemental iron, based on the weight of the catalyst, and the catalyst is modified with one or more alkali or alkaline-earth metals, or (ii) an iron catalyst wherein the iron is dispersed upon an inorganic oxide support, the catalyst containing at least about 0.1 percent iron, based on the total weight of the catalyst, the supported metallic component containing at least 50 percent iron, exclusive of the support component, or components, of the catalyst, and the iron is modified with one or more alkali or alkaline-earth metals.

32. The process of claim 31 wherein the iron catalyst with which the feed and hydrogen are contacted at reaction conditions, when a bulk iron catalyst, is one which contains at least 70 percent to about 98 percent elemental iron.

33. The process of claim 32 wherein the catalyst with which the feed and hydrogen are contacted at reaction conditions is modified with one or more alkali or alkaline-earth metals in concentrations ranging from about 0.01 percent to about 10 percent, and aluminum in concentration ranging from about 0.01 percent to about 20 percent.

34. The process of claim 22 wherein the iron catalyst with which the feed and hydrogen are contacted and reacted in said second zone is a fused iron catalyst.

35. The process of claim 22 wherein the iron catalyst with which the feed and hydrogen are contacted and reacted in said second zone is a supported iron catalyst which contains from about 70 percent to about 98 percent iron, exclusive of the support component, or components.

36. The process of claim 22 wherein the supported iron catalyst is modified with one or more alkali or alkaline-earth metals in concentration ranging from about 0.01 percent to about 10 percent, and aluminum in concentration ranging from about 0.01 percent in about 20 percent.

37. The process of claim 22 wherein the hydrogenated product of said first reaction zone, prior to contact in the second zone with the iron catalyst, is contacted with a hydroisomerization catalyst at hydroisomerization conditions sufficient for rearrangement of the molecular species of said hydrogenated product, inclusive of tetralins, to form indanes and other molecular species, and increase the concentration of indanes and other molecular species in the product which is then employed as a feed to said second reaction zone.

* * * * *